US006245719B1

(12) United States Patent
Kobori

(10) Patent No.: US 6,245,719 B1
(45) Date of Patent: Jun. 12, 2001

(54) LUBRICANT OIL COMPOSITION

(75) Inventor: Atsuhisa Kobori, Tokyo (JP)

(73) Assignee: Tonen Corporation, Saitama (JP)

( * ) Notice: Subject to any disclaimer, the term of this patent is extended or adjusted under 35 U.S.C. 154(b) by 0 days.

(21) Appl. No.: 09/369,568

(22) Filed: Aug. 6, 1999

(30) Foreign Application Priority Data

Mar. 9, 1998 (JP) ..... 10-265705

(51) Int. Cl.[7] ..... C10M 101/02

(52) U.S. Cl. ..... 508/110; 508/371; 208/18; 585/13

(58) Field of Search ..... 208/18; 508/110

(56) References Cited

U.S. PATENT DOCUMENTS

| | | | | |
|---|---|---|---|---|
| 4,800,013 | * | 1/1989 | Yamane et al. | 208/19 |
| 4,812,246 | | 3/1989 | Yabe | 252/32.7 E |
| 5,034,108 | | 7/1991 | Dufour et al. | 204/168 |
| 5,064,546 | * | 11/1991 | Dasai | 208/18 |
| 5,182,248 | | 1/1993 | Cody et al. | 502/230 |
| 5,372,703 | | 12/1994 | Kamiya et al. | 208/58 |
| 5,453,176 | * | 9/1995 | Narloch et al. | 208/58 |
| 5,569,405 | | 10/1996 | Nakazato et al. | 508/192 |
| 5,688,748 | * | 11/1997 | Tomizawa | 508/363 |

FOREIGN PATENT DOCUMENTS

| | | | |
|---|---|---|---|
| 0281992 | 9/1988 | (EP) | C10M/101/00 |
| 0435670 | 7/1991 | (EP) | C10M/101/02 |
| 0713908 | 5/1996 | (EP) | C10M/169/04 |
| 0725130 | 8/1996 | (EP) | C10M/169/04 |
| 60-006790 | 1/1985 | (JP) | C10M/133/56 |
| 63-015895 | 1/1988 | (JP) | C10M/133/56 |
| 1-006094 | 1/1989 | (JP) | C10G/65/12 |
| 1-207394 | 8/1989 | (JP) | C10M/101/04 |
| 1-275698 | 11/1989 | (JP) | C10M/101/02 |
| 4-359994 | 12/1992 | (JP) | C10M/101/02 |
| 7-126681 | 5/1995 | (JP) | C10M/129/10 |
| 7-207290 | 8/1995 | (JP) | C10M/163/00 |
| 9527022 | 10/1995 | (WO) | C10M/133/12 |

* cited by examiner

*Primary Examiner*—Ellen M. McAvoy
(74) *Attorney, Agent, or Firm*—Joseph J. Allocca; Norby L. Foss

(57) ABSTRACT

The present invention is a lubricant oil composition comprising a base oil as the major component which contains aromatic compounds at 1 wt % or less and paraffin and monocyclic naphthene compounds at 50 wt % or more as total content, and has a kinematic viscosity of 2 to 50 $mm^2/s$ at 100° C. and evaporated quantity of 16 wt % or less by the NOACK volatility test.

5 Claims, No Drawings

LUBRICANT OIL COMPOSITION

FIELD OF THE INVENTION

This invention relates to a new lubricant oil composition, more particularly a composition resistant to an air atmosphere containing nitrogen oxide ($NO_x$) gases at high temperature, excellent in oxidation stability in the presence of $NO_x$ and evaporation characteristics, capable of controlling formation of deposits in an air intake system, and suitable for use, e.g., for internal combustion engines, in particular gasoline or diesel engines equipped with a catalytic system to occlude/reduce $NO_x$, or exhaust gas recirculation system, automatic and manual transmissions, final drives, power steerings, shock absorbers and gears.

BACKGROUND OF THE INVENTION

Lubricant oils have been used for internal combustion engines, automatic and manual transmissions, final drives, power steerings, shock absorbers, and gears, for their smooth operation. In internal combustion engines, in particular, lubricant oils have been used to lubricate piston rings, cylinder liners, bearings for crank shafts and connecting rods, valve train mechanisms including cams and valve lifters, and other sliding members. In addition to the lubricating purposes above described, they are also used for cooling engines, cleaning and dispersing combustion products, and preventing rust and corrosion.

As described above, lubricant oils for internal combustion engines are required to exhibit a variety of functions. These requirements are becoming even more sever as the engines become more functional, produce higher power and are operated under more sever conditions. In order to satisfy these requirements, lubricant base oils for internal combustion engines are incorporated with a variety of additives, such as ashless dispersants, metallic detergents, antiwear agents, friction reducing agents and antioxidants.

Combustion gases produced by an internal combustion engine partly leak into the crank case as blow-by gases through a space between the gaps of piston rings. $NO_x$ gases contained in the combustion gases at a fairly high proportion can deteriorate a lubricant oil in the internal combustion engine, in a concerted manner with oxygen present in the blow-by gases. Lean combustion engines and direct injection engines are now being massively used, to improve fuel economy. These engines are quipped with a 3-element catalytic system to occlude/reduce $NO_x$ or with exhaust gas recirculation (EGR) system, to abate $NO_x$ emissions. A three-element catalyst is known to be poisoned by sulfur, and it is necessary, when the catalytic system is adopted, to control the sulfur poisoning resulting from evaporation of the engine oil. It is also necessary, when an EGR system is adopted, to control deposits at the intake valve and contamination of the EGR control valve with the engine oil components, resulting from inflow of the engine oil into the EGR system.

An engine oil for internal combustion engines, in particular lean-combustion engines, is required to be low in volatility and difficult to be deposited even when it is evaporated to flow into the EGR system. In other words, it is required to be high in oxidation stability. Deposits can be also formed by sludge in the oil, resulting from oxidation and deterioration of the oil by $NO_x$ present in the blow-by gases, and the oil is required to control formation of such sludge.

A variety of additives have been proposed to improve oxidation stability and serviceability of engine oils for internal combustion engines. These engine oils include those incorporated with calcium phenate, magnesium sulfonate and alkenyl succinimide (Japanese Patent Publication No. 3-29839) to agglomerate solid impurities, diesel engine oils incorporated with a combination of an ashless dispersant, metallic detergent and the like (Japanese Patent Publication No. 6-60317), engine oils incorporated with an oxidation inhibitor of sulfur-containing phenol derivative or the like (Japanese Laid-open Patent Application No. 6-93281), engine oils incorporated with a specific oxidation inhibitor or the like (Japanese Laid-open Patent Application No. 7-126681), and diesel engine oils incorporated with a combination of 3 types of additives (Japanese Laid-open Patent Application No. 7-207290).

Various types of base oils have been also proposed to improve properties of engine oils. These base oils include those based on mineral oil prepared to have a viscosity index of at least 80, and contain basic nitrogen at 5 ppm or less and aromatic compounds at 1% or less for the lubricant oil composition serviceable in a $NO_x$-containing atmosphere (JP 2,564,556), those based on mineral oil or the like prepared to have a viscosity of 2 to 50 cSt at 100° C. and contain aromatic compounds at 2% or less for internal combustion engine oils (Japanese Patent Publication No. 6-62988), and those based on mineral oil containing total aromatic compounds at 2 to 15 wt %, and isoparaffin and monocyclic naphthene compounds at 60 wt % or more as total content in the saturates (JP 2,724,508).

In spite of these proposals, however, no lubricant oil composition can sufficiently control poisoning of the 3-element catalytic system for occluding/reducing $NO_x$ and deposits in the air intake system in a lean combustion or direct injection engine.

It is an object of the present invention to provide a lubricant oil composition for internal combustion engines, excellent in oxidation stability in the presence of $NO_x$ and evaporation characteristics, and controlling formation of deposits in an air intake system.

SUMMARY OF THE INVENTION

It has been discovered that a lubricant oil composition for internal combustion engines is excellent in oxidation stability in the presence of $NO_x$ and evaporation characteristics and controls formation of deposits in an air intake system, when a mineral oil having a specific content of aromatic compounds, specific total content of paraffin and monocyclic naphthene compounds, and specific evaporated quantity by the NOACK volatility test is used as the base oil for engine oils or the like.

This invention provides a lubricant oil composition comprising a mineral base oil as the major component, which contains aromatic compounds at 1 wt % or less and paraffin and monocyclic naphthene compounds at 50 wt % or more as total content, and has a kinematic viscosity of 2 to 50 $mm^2/s$ at 100° C. and evaporated quantity of 16 wt % or less by the NOACK volatility test.

This invention also provides the above lubricant oil composition, wherein the mineral base oil contains sulfur at 10 ppm or less.

This invention also provides the lubricant oil composition of one of the above two, wherein the base oil is incorporated with 0.04 to 0.10 wt % (as phosphorus) of zinc dithiophosphate.

This invention relates, as described above, to the lubricant oil composition comprising a mineral base oil as the major component, which contains aromatic compounds at a content in a specific range and paraffin and monocyclic naphthene compounds at a total content in a specific range, and has a kinematic viscosity at 100° C. and evaporated quantity by the NOACK volatility test in a specific ranges. Preferred embodiments of the present invention include:

(1) a lubricant oil composition of the above, characterized by being used for internal combustion engines, (2) a lubricant oil composition of the above, characterized by being used for internal combustion engines equipped with a catalytic system to occlude/reduce $NO_x$ or EGR system, and (3) a lubricant oil composition of the above, wherein the base oil is incorporated with a secondary zinc alkyl dithiophosphate as the sole zinc dithiophosphate compound.

DESCRIPTION OF THE INVENTION

The present invention is described in more detail below.

(1) Lubricant base oil

It is important that the base oil for the lubricant oil composition of the present invention contains aromatic compounds at 1 wt % or less and paraffin and monocyclic naphthene compounds at 50 wt % or more as total content, and has a kinematic viscosity of 2 to 50 $mm^2/s$ at 100° C. and evaporated quantity of 16 wt % or less by the NOACK volatility test. It is preferable that the above base oil as the major component of the lubricant oil composition of the present invention further contains sulfur at 10 ppm or less.

The mineral base oil for the lubricant oil composition as the major component of the present invention contains, first of all, aromatic compounds at 1 wt % or less, preferably 0.5 wt % or less, more preferably 0.2 wt % or less, wherein the aromatic content is determined in accordance with ASTM D2549. At an aromatic content above 1 wt %, stability of the lubricant oil composition against $NO_x$ will be insufficient, making it difficult to achieve the object of the present invention, because of excessive deterioration in an atmosphere containing $NO_x$.

The above base oil contains paraffin and monocyclic naphthene compounds at 50 wt % or more as total content, wherein these compounds are determined in accordance with ASTM D2786. At a total content of these compounds below 50 wt %, the lubricant oil composition will be evaporated excessively, and show insufficient evaporation characteristics.

It is preferable that the above base oil contains sulfur at 10 ppm or less. At a sulfur content above 10 ppm, the 3-element catalyst to occlude/reduce $NO_x$, as the one to clean up exhaust gases from an automobile may be poisoned by sulfur, when the engine oil is consumed. One of the causes for the sulfur poisoning is oxidation of sulfur contained in the fuel and lubricant oil into $SO_x$ and/or sulfate, which react with the $NO_x$-occluding material to damage its $NO_x$-occluding capacity, making it difficult to clean up the exhaust gases by reducing $NO_x$.

The above base oil has a kinematic viscosity of 2 to 50 $mm^2/s$ at 100° C., preferably 3 to 15 $mm^2/s$. A kinematic viscosity below 2 $mm^2/s$ at 100° C. may cause problems, such as excessive loss of the lubricant oil by evaporation, and increased wear at the sliding members, e.g., piston rings and valve train systems. A kinematic viscosity above 50 $mm^2/s$, on the other hand, is undesirable, because of insufficient viscosity at low temperature to increase wear-caused loss by agitation resistance.

The above base oil also has an evaporated quantity of 16 wt % or less by the NOACK volatility test, wherein the evaporated quantity represents the evaporation loss, determined in accordance with CEC L-40T-87 under the conditions of 250° C., 1 h and −20 mm $H_2O$. A NOACK evaporation loss above 16 wt % may cause problems, such as increased consumption of the engine oil due to excessive evaporation, excessively increased viscosity, and sulfur-poisoning of the 3-element catalyst to occlude/reduce $NO_x$, resulting from excessive evaporation of the engine oil.

The base oil as the major component of the lubricant composition of the present invention is not limited, so long as the above requirements are satisfied. Any one commonly used as a base oil can be used for the present invention.

The natural mineral base oils useful for the present invention include lubricant stocks, obtained by atmospheric or vacuum distillation of paraffinic, intermediate base or naphthenic crude, e.g., raffinate from solvent extraction with an aromatic compound extracting solvent such as phenol, furfural and N-methyl pyrrolidone; hydrotreated oil obtained by treating stocks with hydrogen under hydrotreatment conditions in the presence of a hydrotreatment catalyst, such as cobalt and molybdenum carried by silica-alumina; hydrocrakate obtained by treating stocks with hydrogen under severe hydrocracking conditions; isomerate obtained by isomerizing stocks with hydrogen under isomerization conditions in the presence of an isomerization catalyst; and those stocks obtained by a combination of solvent refining, hydrotreatment, hydrocracking or isomerization. Particularly preferable base oils for the present invention are hydrocrackate and stocks having a high viscosity index, obtained by hydrocracking or isomerization. Any process described above can be optionally combined with dewaxing, hydrofinishing, clay treatment or the like operated in a normal manner. More specifically, the base stocks useful for the present invention include light, medium and heavy neutral oils, and bright stocks. These base oils can be mixed one another, to satisfy the requirements for the present invention.

The lubricant oil composition of the present invention comprises the mineral oil based base oil, as the major component, which have the above described requirements in terms of composition and properties. This base oil may be incorporated with a small quantity of another type of base oil, as required, so long as the object of the present invention is not damaged. Such a base oil is not limited, and any mineral or synthetic stock which is normally used as a base oil can be used. When another type of base oil is incorporated, it is preferable that the total base oil satisfies the above described requirements.

(2) Zinc dithiophosphate

It is preferable that the base oil for the lubricant composition of the present invention is incorporated with a zinc dithiophosphate as the antiwear agent and antioxidant. The zinc dithiophosphate is represented, e.g., by the general formula [I]:

[I]

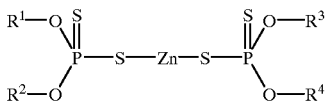

wherein, $R^1$, $R^2$, $R^3$ and $R^4$ are each hydrogen or a hydrocarbon group having a carbon number of 1 to 26, e.g., a primary or secondary alkyl having a carbon number of 1 to 26; alkenyl having a carbon number of 2 to 26; cycloalkyl having a carbon number of 3 to 26; aryl, alkyl aryl or arylalkyl having a carbon number of 3 to 26; or a hydrocarbon group containing an ester or ether bond, or hydroxyl or carboxyl group. Each of them is preferably an alkyl group having a carbon number of 2 to 12, cycloalkyl group having a carbon number of 8 to 18, or alkyl aryl group having a carbon number of 8 to 18. They may be the same or different from each other. Each of them is more preferably a secondary alkyl group.

It is preferable that a zinc dithiophosphate is incorporated at 0.04 to 0.10 wt % as phosphorus derived from the zinc dithiophosphate, based on the whole composition. At below 0.04 wt %, its wear inhibiting effect may be insufficient under the conditions of high temperature and low rotational velocity. On the other hand, increasing its content beyond 0.10 wt % may not increase its wear inhibiting effect as expected from the increased content, and may conversely cause problems, such as sulfur poisoning of the 3-element catalyst to occlude/reduce $NO_x$ as the one used to clean up automobile exhaust gases, because of increased sulfur content derived from the zinc dithiophosphate as the engine oil is consumed.

(3) Other additive components

The lubricant oil composition comprises the base oil having the above described composition and properties, which is preferably incorporated with a zinc dithiophosphate as the antiwear agent and antioxidant. The base oil may be optionally incorporated further with one or more types of additives which are normally used for lubricant oils for internal combustion engines, so long as the object of the present invention is not damaged. These additives include an ashless dispersant, metallic detergent, antiwear agent, friction reducing agent, antioxidant, viscosity index improver, pour point depressant, metal deactivator, rust inhibitor, corrosion inhibitor and antifoamant.

The ashless dispersants useful for the present invention include those based on polyalkenyl succinimide, polyalkenyl succinamide, benzyl amine, succinic acid ester, and succinic acid-amide, and those containing boron. Of these, polyalkenyl succinimide (polybutenyl succinimide)-based ones and boron-containing ones are preferably used. The ashless dispersant, when one is used, is incorporated normally at 0.1 to 10 wt %.

The metallic detergents useful for the present invention include those based on sulfonate of Ca, Mg, Ba and the like, phenate, salicylate and phosphonate. The metallic detergent, when one is used, is incorporated normally at 0.05 to 5 wt %.

The antiwear agents useful for the present invention include, in addition to zinc dithiophosphate described above, metallic (e.g., Mo, Pb and Sb) salts of dithiophosphoric acid, metallic (e.g., Mo, Pb and Sb) salts of dithiocarbamic acid, metallic (e.g., Pb) salts of naphthenic acid, metallic (e.g., Pb) salts of fatty acids, boron compounds, phosphoric acid esters, phosphorous acid esters and phosphoric acid amines. Of these, phosphoric acid esters and metallic salts of dithiophosphoric acid are preferably used. The antiwear agent, when one is used, is incorporated normally at 0.05 to 5 wt %.

The friction reducing agents useful for the present invention include organomolybdenum compounds, fatty acids, higher alcohols, fatty acid esters, oils and greases, (partial) esters of polyalcohols, sosorbitan esters, amines, amides, sulfided esters, phosphoric acid esters, phosphorous acid esters and phosphoric acid ester amines. The friction reducing agent, when one is used, is incorporated normally at 0.05 to 3 wt %.

The antioxidants useful for the present invention generally include amine-based ones, e.g., alkylated diphenyl amine, phenyl-α-naphthyl amine and alkylated phenyl-α-naphthyl amine; phenol-based ones, e.g., 2,6-ditertiary butyl phenol and 4,4'-methylene bis-(2,6-6-ditertiary butyl phenol); sulfur-based ones, e.g., dilauryl-3,3'-thiodipropionate; phosphorus-based ones, e.g., phosphite; and zinc dithiophosphate. Of these, amine-based and phenol-based antioxidants are preferably used. The oxidation inhibitor, when one is used, is incorporated normally at 0.05 to 5 wt %.

The viscosity index improvers useful for the present invention generally include polymethacrylate-based ones, olefin copolymer-based ones (e.g., isobutylene-based and ethylene-propylene copolymer-based ones), polyalkyl styrene-based ones, hydrogenated styrene-butadiene copolymer-based ones, and styrene-maleic anhydride ester copolymer-based ones. Of these, polymethacrylate-based and olefin copolymer-based ones are preferably used. The viscosity index improver, when one is used, is incorporated normally at 1 to 15 wt %.

The pour point depressants useful for the present invention generally include ethylene-vinyl acetate copolymers, condensates of chlorinated paraffin and naphthalene, condensates of chlorinated paraffin and phenol, polymethacrylates, and polyalkyl styrenes. Of these, polymethacrylates are preferably used. The pour point depressant, when one is used, is incorporated normally at 0.01 to 5 wt %.

The metal deactivators useful for the present invention include benzotriazole, triazole derivatives, benzotriazole derivatives and thiadiazole derivatives. The metal deactivator, when one is used, is incorporated normally at 0.001 to 3 wt %.

The rust inhibitors useful for the present invention include fatty acids, alkenyl succinic acid half esters, fatty acid soaps, alkyl sulfonates, esters of fatty acids and polyalcohols, aliphatic amines, oxidized paraffin compounds and alkyl polyoxyethylene ethers. The rust inhibitor, when one is used, is incorporated normally at 0.01 to 3 wt %.

The lubricant oil composition of the present invention may be further incorporated, as required, with other types of additives, e.g., corrosion inhibitor, antifoamant and coloring agent.

EXAMPLES AND COMPARATIVE EXAMPLES

The present invention is described below in detail by Examples and Comparative Examples, which by no means limit the present invention. The oxidation stability in the presence of $NO_x$ and evaporation characteristics, cited in Examples and Comparative Examples were analyzed by the following methods:

(1) Oxidation stability in the presence of $NO_x$

The oxidation test was conducted using air containing $NO_x$ gases, to simulate an engine exposed at high temperature to blow-by gases containing $NO_x$ gases, where 150 mL of the sample oil was exposed to a flow of air containing 1 vol % of $NO_2$, flowing at 2 L/h ($NO_2$:0.02 L/h, air:1.98 L/h) at 155° C. for 48 hours. The oxidation stability was assessed by ratio of kinematic viscosity of the tested sample to that of the untested one. The test sample is judged to have good oxidation stability, when the kinematic viscosity ratio is below 1.2. The insolubles (wt %) in the tested oil, determined in accordance with ASTM D893 (pentane-insolubles method B), was also measured, to assess quantity of sludge formed as a result of deterioration of the tested oil by $NO_2$. The sludge in the oil causes deposits in an air intake system, and the tested oil is judged to have good capacity for controlling deposit formation, when it contains the pentane-insolubles at below 1 wt %.

(2) Evaporation characteristics

The evaporation characteristics of the test sample was assessed by the NOACK volatility test to determine evaporated quantity. As described earlier, the evaporated quantity represents the evaporation loss, determined in accordance with CEC L-40-T-87 under the conditions of 250° C., 1 h and −20 mm $H_2O$. The development target was set at an evaporated quantity of 15 wt % or less by the NOACK volatility test, the level being considered to give a lubricant oil good evaporation characteristics.

Example 1

The base oil 1, whose composition and properties are given in Table 1, was used as the base oil which was incorporated with given concentrations, based on the total composition, of commonly used necessary additives, to prepare the lubricant oil composition. It was subjected to the tests for oxidation stability in the presence of $NO_x$ and evaporation characteristics. The results are given in Table 2. The lubricant oil composition exhibits good oxidation stability in the presence of $NO_x$ and evaporation characteristics.

Example 2

The base oil 1 was used as the base oil, as was the case with Example 1, which was incorporated with 0.095 wt % (as phosphorus, based on the total composition) of a secondary alkyl ($C_6$) zinc dithiophosphate and given concentrations of other, commonly used necessary additives, to prepare the lubricant oil composition. It was subjected to the tests for oxidation stability in the presence of $NO_x$ and evaporation characteristics, also as was the case with Example 1. The results are given in Table 2. The lubricant oil composition exhibits good oxidation stability in the presence of $NO_x$ and evaporation characteristics.

Example 3

The base oil 2, whose composition and properties are given in Table 1, was used as the base oil which was incorporated with 0.095 wt % (as phosphorus, based on the total composition) of a secondary alkyl ($C_6$) zinc dithiophosphate and given concentrations of other, commonly used necessary additives, to prepare the lubricant oil composition. It was subjected to the tests for oxidation stability in the presence of $NO_x$ and evaporation characteristics, also as was the case with Examples 1 and 2. The results are given in Table 2. The lubricant oil composition exhibits good oxidation stability in the presence of $NO_x$ and evaporation characteristics.

Comparative Examples 1 to 3

The base oil 3 or 4, whose composition and properties are given in Table 1, was used as the base oil which was incorporated with additives in a ratio given in Table 2, to prepare the lubricant oil composition, in a manner similar to that for Example 1, 2 or 3. Each composition was subjected to the tests for oxidation stability in the presence of $NO_x$ and evaporation characteristics. The results are given in Table 2.

TABLE 1

| | | Base Oil 1 | Base Oil 2 | Base Oil 3 | Base Oil 4 |
|---|---|---|---|---|---|
| Kinematic viscosity @ 100° C. | $mm^2/s$ | 4.7 | 5.0 | 4.2 | 4.8 |
| Aromatic content | wt % | 0.1 | 0.0 | 4.2 | 7.3 |
| Total content of paraffin and monocyclic naphthene compounds | wt % | 57 | 51 | 47 | 42 |
| Sulfur content | wt % | 0.00 | 0.00 | 0.10 | 0.31 |
| Evaporated quantity determined by NOACK volatility test | wt % | 16 | 13 | 25 | 19 |

TABLE 2

| | | Example 1 | Example 2 | Example 3 | Comparative Example 1 | Comparative Example 2 | Comparative Example 3 |
|---|---|---|---|---|---|---|---|
| Base oil 1 | wt % | Balance (85.7) | Balance | — | — | — | — |
| Base oil 2 | wt % | — | — | Balance | — | — | — |
| Base oil 3 | wt % | — | — | — | Balance (85.7) | Balance | — |
| Base oil 4 | wt % | — | — | — | — | — | Balance |
| Sec. $C_6$—ZnDTP (1) | wt % as P in oil | 0 | 0.095 | 0.095 | 0 | 0.095 | 0.095 |
| Other additives (2) | wt % | 14.3 | 14.3 | 14.3 | 14.3 | 14.3 | 14.3 |
| Kinematic viscosity of composition @ 100° C. | $mm^2/s$ | 9.6 | 10.1 | 10.3 | 8.9 | 9.5 | 10.2 |
| Evaporated quantity determined by NOACK test | wt % | 15 | 15 | 13 | 24 | 23 | 18 |
| Oxidation stability in the presence of $NO_x$ (155° C., 48 hours) | | | | | | | |
| Kinematic viscosity of tested oil @ 100° C. | $mm^2/s$ | 10.0 | 10.3 | 10.6 | 13.4 | 12.6 | 13.7 |
| Ratio of kinematic viscosity @ 100° C. | | 1.04 | 1.02 | 1.03 | 1.51 | 1.33 | 1.34 |
| Insolubles in tested oil (sludge) (3) | wt % | 0.67 | 0.52 | 0.43 | 2.11 | 1.74 | 1.92 |

(1) Sec Alkyl ($C_6$) zinc dithiophosphate was added at a concentration shown above as phosphorus.
(2) Other additives, i.e., ashless dispersant, metallic detergent, viscosity index improver and antifoamant, were added at given concentrations.
(3) Pentane-insolubles, determined in accordance with ASTM D893 (Method B)

It is apparent, as shown by the results of Examples and Comparative Examples, that a lubricant oil composition exhibits good oxidation stability in the presence of $NO_x$, because of a small increase in kinematic viscosity by the oxidation test, a small quantity of insolubles (sludge) formed, good evaporation characteristics and high quality, when its base oil contains a specific content of aromatic compounds and a specific total content of paraffin and monocyclic naphthene compounds, and has a specific kinematic viscosity at 100° C. and evaporated quantity by the NOACK volatility test. Taking the results of Example 1 as an example, the composition, when subjected to the test of oxidation stability in the presence of $NO_x$, has a kinematic viscosity only 1.04 higher than that of the untested sample, indicating little increase by the test, and a limited content of the insolubles, i.e., pentane-insolubles determined in accordance with ASTM D893 (method B), at 0.67 wt %. It also exhibits an evaporated quantity of 15 wt %, determined by the NOACK volatility test, which satisfies the development target. The lubricant oil compositions prepared by Examples 2 and 3 similarly exhibit high quality.

On the other hand, each of the lubricant oil compositions prepared by Comparative Examples 1 to 3 comprised a base oil which, although having a kinematic viscosity at 100° C. within the range for the present invention, was out of the ranges for the present invention with respect to content of aromatic compounds, total content of paraffin and monocyclic naphthene compounds, and evaporated quantity by the NOACK volatility test. When subjected to the test for oxidation stability in the presence of $NO_x$, it exhibited a significant increase in kinematic viscosity to give a higher kinematic viscosity ratio, and a larger quantity of the insolubles formed by the test. It also exhibited a larger evaporated quantity by the NOACK volatility test.

It is apparent, based on these results, that a lubricant oil composition exhibiting good oxidation stability in the presence of $NO_x$, good evaporation characteristics and high quality is difficult to obtain, unless its base oil contains a specific content of aromatic compounds and a specific total content of paraffin and monocyclic naphthene compounds, and has a specific kinematic viscosity at 100° C. and evaporated quantity by the NOACK volatility test. In other words, it is apparent that a composition exhibits good oxidation stability in the presence of $NO_x$ and good evaporation characteristics, and controls formation of deposits in an air intake system, when its base oil contains a specific content of aromatic compounds and a specific total content of paraffin and monocyclic naphthene compounds, and has a specific kinematic viscosity at 100° C. and evaporated quantity by the NOACK volatility test.

The lubricant oil composition of the present invention exhibits good oxidation stability in the presence of $NO_x$ and good evaporation characteristics, and controls formation of deposits in an air intake system by use of a base oil as the major component which contains a specific content of aromatic compounds and a specific total content of paraffin and monocyclic naphthene compounds, and has a specific kinematic viscosity at 100° C. and evaporated quantity by the NOACK volatility test. The lubricant oil composition of the present invention is useful for internal combustion engines, in particular gasoline or diesel engines equipped with a catalytic system to occlude/reduce $NO_x$ or exhaust gas recirculation system, automatic and manual transmissions, final drives, power steerings, shock absorbers and gears.

What is claimed is:

1. A lubricant oil composition comprising a mineral oil base oil as the major component, which contains aromatic compounds at 1 wt % or less and paraffin and monocyclic naphthene compounds at 50 wt % or more as total content, and has a kinematic viscosity of 2 to 50 $mm^2/s$ at 100° C. and evaporated quantity of 16 wt % or less by the NOACK volatility test.

2. A lubricant oil composition of claim 1, wherein said mineral oil base oil contains sulfur at 10 ppm or less.

3. A lubricant oil composition of claim 1 or 2, wherein said mineral oil base oil is incorporated with 0.04 to 0.10 wt % (as phosphorus) of zinc dithiophosphate.

4. A method for controlling formation of deposits in internal combustion engines by lubricating said engine with a lubricant comprising a mineral base oil containing aromatic compounds at 1 wt % or less and paraffins and monocyclic naphthene compounds at 50 wt % or more as total content, and having a kinematic viscosity of 2 to 50 $mm^2/s$ at 100° C. and an evaporation quantity of 16 wt % or less by the NOACK volatility test.

5. The method of claim 4 wherein the internal combustion engine is equipped with a catalytic system to occlude/reduce $NO_x$ or with an exhaust gas recirculation system.

* * * * *